United States Patent [19]

Kamens et al.

[11] Patent Number: 4,618,264

[45] Date of Patent: Oct. 21, 1986

[54] ACOUSTIC ALARM SETTING DEVICE FOR A TIMEPIECE

[75] Inventors: Bruce H. Kamens, Thomaston; George E. Ritter, Southbury, both of Conn.

[73] Assignee: Timex Corporation, Waterbury, Conn.

[21] Appl. No.: 780,134

[22] Filed: Sep. 25, 1985

[51] Int. Cl.[4] ..... H01H 43/00; G04C 9/08

[52] U.S. Cl. ..... 368/74; 368/187; 368/251

[58] Field of Search ..... 368/69–74, 368/107–109, 185, 187, 250–251, 255

[56] References Cited

U.S. PATENT DOCUMENTS

| | | | |
|---|---|---|---|
| 4,196,583 | 4/1980 | Komaki | 368/77 |
| 4,209,976 | 7/1980 | Flumm | 368/187 |
| 4,246,650 | 7/1981 | Moritani et al. | 368/69 |
| 4,253,177 | 2/1981 | Hafner | 368/187 |
| 4,376,993 | 3/1983 | Freeman | 368/74 |
| 4,477,194 | 10/1984 | Michel et al. | 368/69 |
| 4,504,154 | 3/1985 | Kammerer | 368/74 |

*Primary Examiner*—Vit W. Miska

*Attorney, Agent, or Firm*—William C. Crutcher

[57] ABSTRACT

An electronic alarm timepiece has a rotatable ring producing clicks when the ring is rotated from a first position aligned with one of the hands to a second position at which the alarm will be actuated when the hand reaches such position. The clicks are transmitted to the electronic timepiece logic through the same piezoelectric transducer which produces the alarm sound. The logic means actuates the alarm after an elapsed time which is proportional to the number of clicks counted when the ring is rotated.

13 Claims, 8 Drawing Figures

ACOUSTIC ALARM SETTING DEVICE FOR A TIMEPIECE

BACKGROUND OF THE INVENTION

This invention relates generally to an improved means of setting the alarm time for an electronic alarm timepiece.

Electronic alarm timepieces are known which include a piezoelectric transducer and alarm driving circuit for causing the transducer to produce an audible sound after an elapsed time has been measured by the timekeeping circuitry of the electronic timepiece, or after the alarm set time coincides with the actual time. When the timepiece has a digital display, there is normally a pushbutton which can be actuated to place the display in alarm mode and easily set the desired time for the alarm to sound. However, in a quartz analog watch having hands driven by a stepping motor, indicating and setting the desired time for the alarm to go off is more difficult. Several schemes have been devised for temporarily moving the hands to indicate the alarm set time. These are always complicated, because some means must be provided to return the hands to show the correct time again after they have been moved, without losing track of the correct time.

U.S. Pat. No. 4,223,523 - Kamijo discloses an electronic analog wristwatch with an alarm which is set by rapidly, electromechanically driving the watch hands forward to the desired alarm time, slowly advancing the hands electromechanically to the exact alarm setting, and then rapidly returning by electromechanically driving the hands to the actual present time. The number of pulses required for hand return are counted and used to actuate an alarm when a coincidence detector indicates that a number of real time pulses after return of the hands equals the count stored in memory.

U.S. Pat. No. 4,358,840 - Ono et al., discloses an electronic alarm timepiece with circuitry for controlling the drive of the hands by a reversible stepping motor to selectively position the hands at a desired alarm time and display time settings. A time difference counter is implemented for counting and storing the value corresponding to the difference in time between the alarm time and the present time. Another counter is used to activate the alarm when its content becomes zero.

U.S. Pat. No. 4,419,019 - Nishimura discloses a means for rapidly rotating the timepiece hands to indicate an alarm time, and further includes means for more precisely setting the alarm time by rotating the crown to generate drive pulses for advancing the timepiece hands in steps of one minute in the alarm time setting mode. The crown rotation actuates switches which provide setting pulses as well as providing audible click sounds to the operator.

U.S. Pat. No. 4,470,707 - Chambon et al., assigned to the present assignee, discloses an arrangement for setting the alarm time using the minute and second hand to indicate the alarm time in hours and minutes, by counting and storing the number of pulses produced when rotating the hands from a given reference position to the alarm set position.

All of the foregoing arrangements require changing the position of the timekeeping hands and therefore require complicated systems to return the hands to their former position, while compensating for time elapsed during setting.

Rotatable rings mounted on the watch bezel for indicating elapsed time through indicia which are compared to the hands of the watch are well-known, as illustrated in U.S. Pat. No. 3,553,958 - Grohoski, assigned to applicants' assignee. It is also well-known that a piezoelectric transducer used to produce an alarm sound or beeping sound in an electronic wristwatch can also act as a microphone to produce electronic pulses upon receipt of acoustic energy or sound impulses. An example of use of this principle to set a digital watch is illustrated in U.S. Pat. No. 4,477,194 - Michel et al. In this watch, ribbed zones on the watch bezel are scratched or rubbed to produce noise pulses or spikes detected by the electronic circuit to enable watch setting functions.

There is a great need for a simple means to set an electronic analog alarm timepiece without disturbing the setting of the timekeeping hands.

Accordingly, one object of the present invention is to provide an improved means for setting an alarm in an electronic alarm timepiece.

Another object of the present invention is to provide an improved means for indicating elapsed time for a timer.

DRAWING

Other objects of the invention will become apparent from the following description, taken in connection with the accompanying drawing, in which:

FIG. 1 is a plan view of a timepiece incorporating the invention,

FIG. 2 is a schematic diagram of the functional elements and circuitry illustrating the operation, FIG. 3 is a plan view of one type of acoustic "click" mechanism useful in the present invention, FIG. 4 is a elevation view of an enlarged cross section taken along lines IV—IV of FIG. 1, FIG. 5 is a plan view of a enlarged cross section of FIG. 4, taken along lines V—V, FIG. 6 is a representative chart of acoustic energy level versus time, FIG. 7 is a logic flow chart illustrating a preferred implementation of the logic circuitry, and FIG. 8 is a plan view of the timepiece utilizing the invention as an elapsed minute timer.

SUMMARY OF THE INVENTION

Briefly stated, the invention is practiced by providing an improvement in an electronic alarm timepiece of the type having at least one hand indicating the passage of time and a piezoelectric transducer, and an alarm for producing an alarm sound. The improvement comprises provision of a rotatable ring mounted on the timepiece having an indicia for aligning with a hand in a first position, acoustic means associated with the rotatable ring for producing a number of clicks when the ring is rotated to a second position, means for counting the number of clicks, and logic means for actuating the alarm after an elapsed time proportional to the number of clicks has passed.

In its preferred form, the transudcer is used for sensing the clicks and also for producing the alarm sound. An up/down counter stores a number equal to the number of pulses generated by clicks when counting up, and then is caused to count down by timing pulses produced by the timekeeping circuit. The alarm is actuated when the count is equal to zero. The foregoing logic may be implemented either in a hardwired circuit or as suitable instructions in a program.

DESCRIPTION OF THE PREFERRED EMBODIMENT

Figure 1:
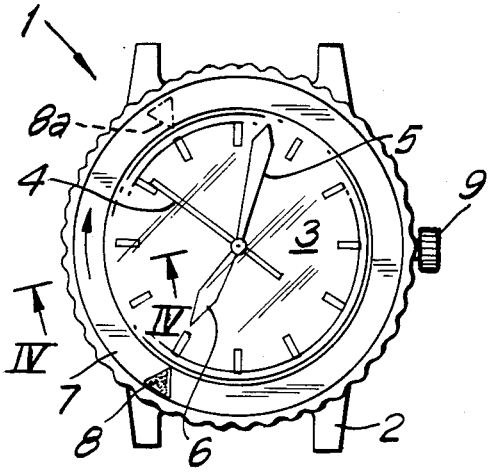

Referring to FIG. 1 of the drawing, a timepiece shown generally at 1 is represented by an electronic analog timepiece of a known type having a bezel 2 with a dial 3, second hand 4, minute hand 5 and hour hand 6. A rotatable ring 7 is mounted on the timepiece bezel and includes an indicia shown as indicator 8 aligned with hour hand 6. The rotatable ring 7 may be rotated to move it from the first rotated position shown in FIG. 1 to a second rotated position, at which the indicator is represented in phantom line by reference numeral 8*a*. An external switch or pushbutton 9 may be used to set the time through internal switches (not shown).

Figure 2:
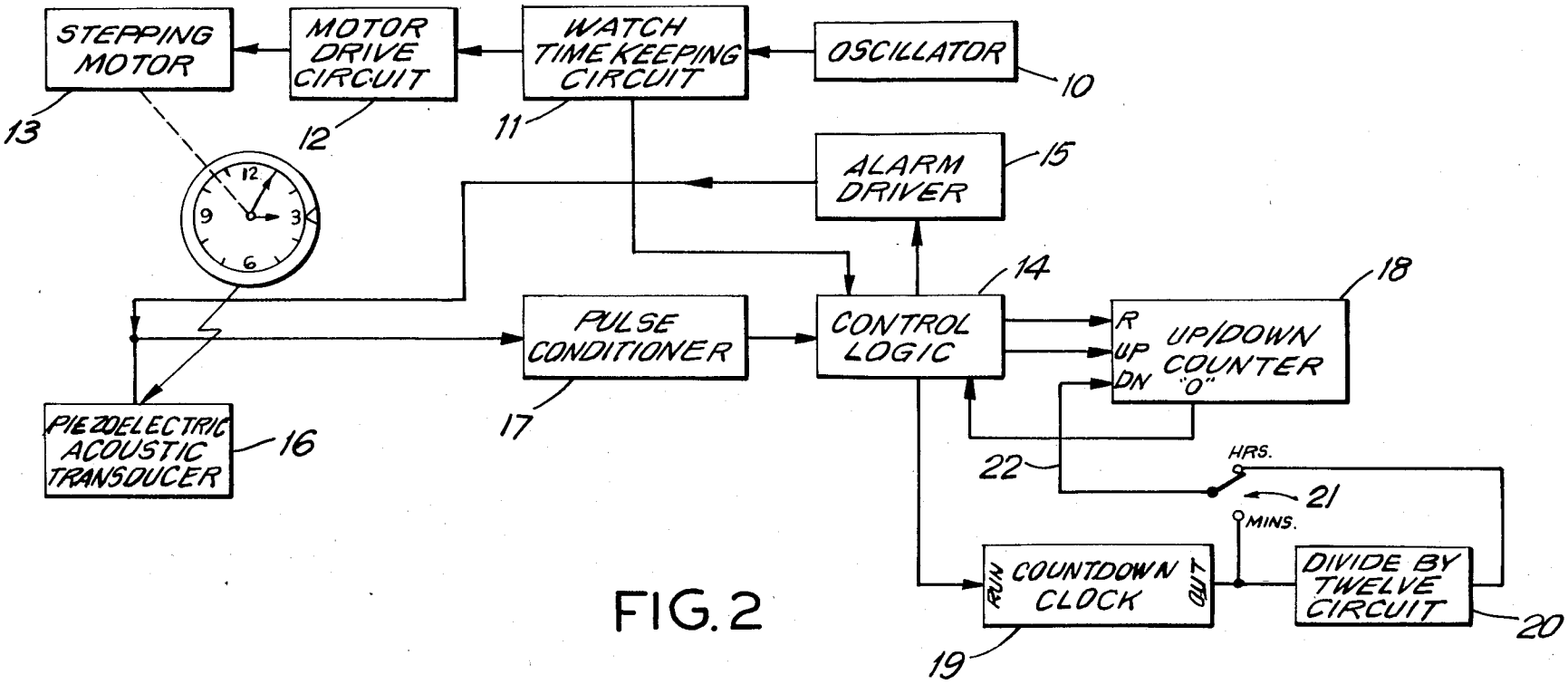

Referring to FIG. 2 of the drawing, the conventional elements of the timepiece include an oscillator 10, watch timekeeping circuit 11, a stepping motor drive circuit 12, and a stepping motor 13 connected through a gear train to drive the timepiece hands. The stepping motor and hands together comprise display-actuating means for displaying the passage of time. If the watch were a liquid crystal analog watch, the display-actuating means would be electronically displayed electronic "hands" on the face of the liquid crystal display.

The watch timekeeping circuit is preferably implemented in an integrated circuit in a known manner. Accurate timing pulses are provided from the timekeeping circuit 11 to a control logic circuit 14, which has an output connected to an alarm driver circuit 15, in turn connected to a piezoelectric transducer 16. The latter is generally a wafer of piezoelectric material attached to a part of the watch bezel or caseback, so that when it receives driving pulses from the alarm driver circuit 15, it produces periodic "beeps" in a known manner. The transducer 16, when subjected to acoustic energy or noise of any sort, produces electrical potential which is fed back to a pulse conditioner 17, the output of which is connected to the control logic circuit 14. The pulse conditioner consists of a lever detector triggering a monostable multivibrator.

An up/down counter 18 is also connected to the control logic circuit 14, providing a first counting means. The counter, which is of a known type, includes an "up" input which increments the counter, a "down" input which decrements the counter, an output terminal "0" which outputs a signal to the control logic circuit when the count has reached zero, and a reset terminal "R".

A countdown clock 19 is connected to provide a succession of timing pulses at its output when it receives an input signal from control logic 14. A divide-by-twelve circuit 20 is connected to receive pulses from the clock 19 and to supply one output pulse for every sixty input pulses to an "hours" contact of a selector switch 21. Pulses from the clock 19 are supplied directly to the other "minutes" contact of the selector switch. A selector 22 allows for selection of either rate of pulses from clock 19 and divider 20 to be supplied to the "down" input terminal of up/down counter 18 over a lead 22.

Figure 3:
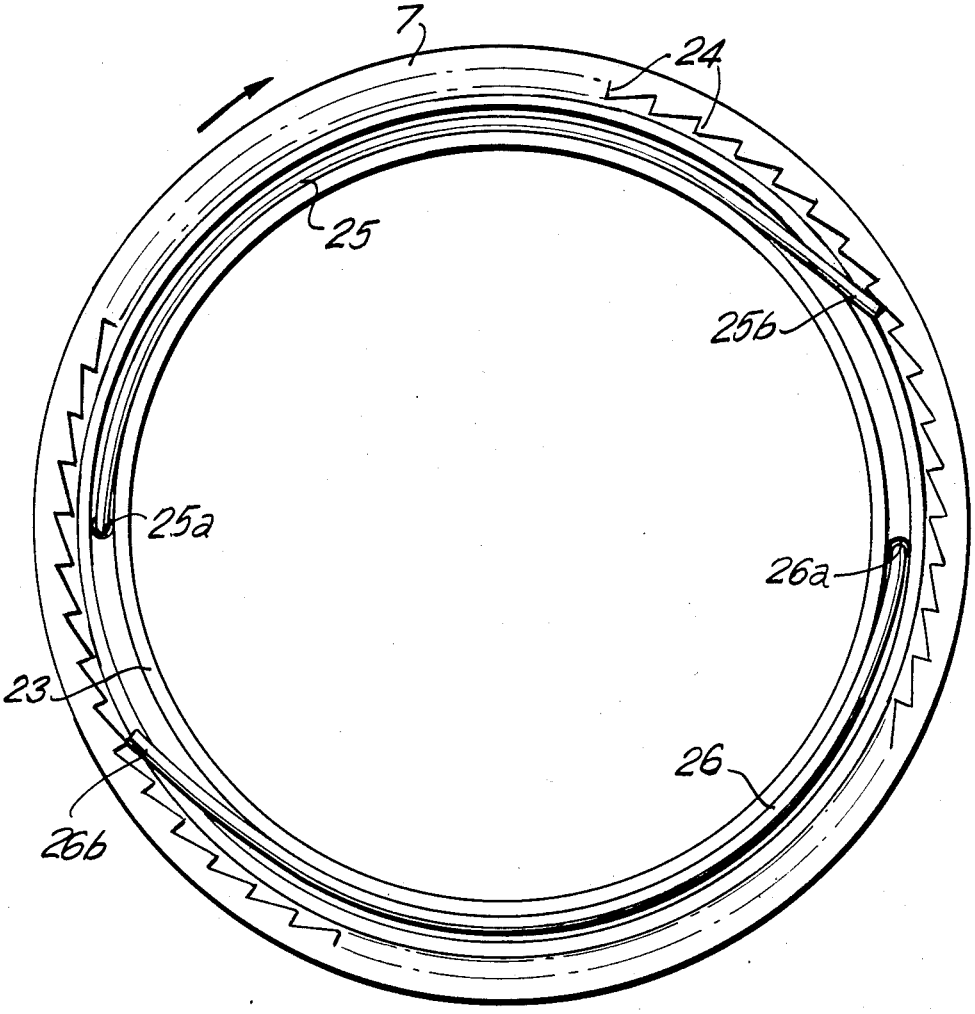

Referring to FIG. 3 of the drawing, the rotatable ring is provided with acoustic means to produce "clicks" when the ring is rotated. Ring 7 is shown in FIG. 3 as being rotatable in a clockwise direction with respect to a stationary part of the bezel indicated by reference numeral 23. An interior portion of ring 7 defines 60 beveled teeth 24. A pair of spring wire members 25, 26 are wrapped around the stationary bezel portion 23 and held at one end by being bent down into holes in the bezel as indicated at 25*a*, 26*a*. The bent springs are biased against the teeth 24. The free ends of the wire springs shown at 25*b*, 26*b* ride on the teeth 24 so that perceptible clicks will be produced when the ring is rotated clockwise. The wires are either of slightly different length, or are of the same length, but mounted slightly away from diametral positions, as shown, so that one wire is offset by one half tooth pitch to rest on the middle of a tooth, while the other wire is producing a click. Thus, 120 clicks will be produced for a full revolution of the alarm set ring 7. Greater setting resolution may be provided by adding more acoustic click springs, so that if there are "t" teeth on the ring and "n" springs, there will be "nt" clicks produced per revolution of the ring.

The rate of timing pulses from divider 20 is selected such that the number of pulses produced in the time that it takes the hour hand to rotate through a given arc is equal to the number of clicks which are produced when the rotatable ring is rotated through the same arc. Since the minute hand rotates 12 times as fast as the hour hand, the pulses supplied by the clock from the "minutes" contact to the up/down counter will also be the proper number when the rotatable ring is employed using the minute hand instead of the hour hand.

Figure 4:
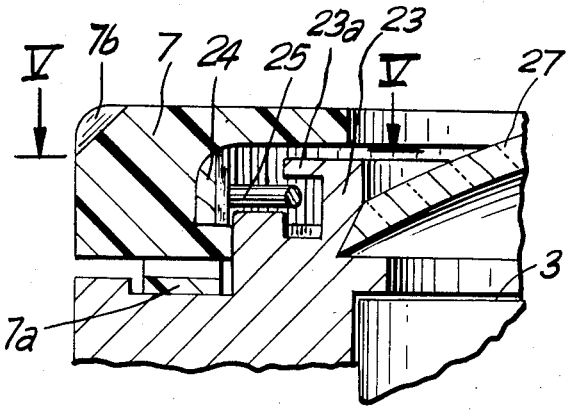
Figure 5:
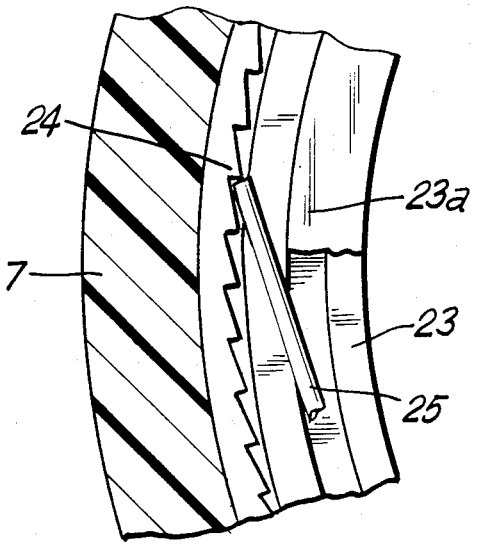

Further enlarged detail views are shown of the alarm set ring in FIGS. 4 and 5. FIG. 4 shows the ring 7 mounted on bezel 23 outside of the watch crystal 27. The ring may be provided with a spring member 7*a* to keep it from moving inadvertently, and knurling 7*b* to facilitate twisting it manually, in the manner of the aforesaid Grohoski patent. The bezel member 23 is provided with a lip 23*a* to retain the springs in place.

Figure 6:
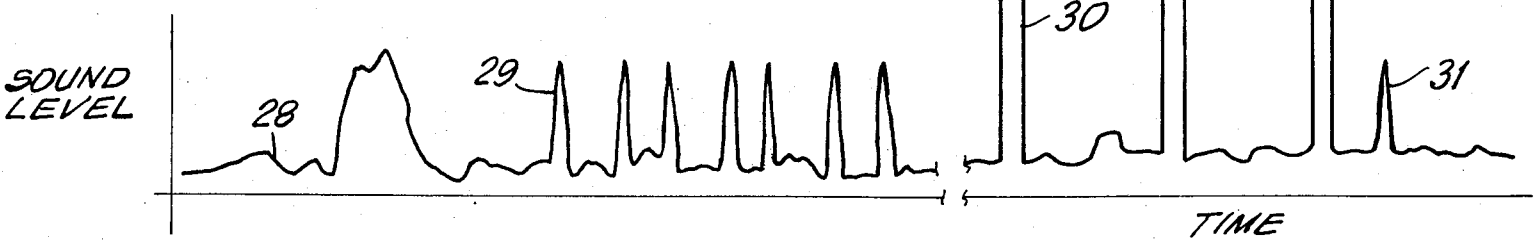

FIG. 6 of the drawing illustrates schematically the acoustic energy level to which the transducer 16 is submitted in operation, using an arbitrary scale of sound energy on the vertical axis. The transducer 16 will "hear" noise of random sound energy levels over a period of time, which is depicted at 28 on the graph. When the ring is rotated, a series of noise spikes 29 are produced by the clicks. If the ring is rotated at a constant speed, and if the wires are offset by the proper amount, the spikes will be equally spaced. However, equal spacing is not a requisite of the present invention, so long as the time between clicks does not exceed a predetermined time set in the control logic.

When the alarm circuit 15 is activated, there will be a series of beeps emitted by the transducer, which are also fed back in the form of sound impulses 30. These may be terminated, as will be explained, by subsequent rotation of the ring producing a click or noise spike 31 between beeps.

Figure 7:
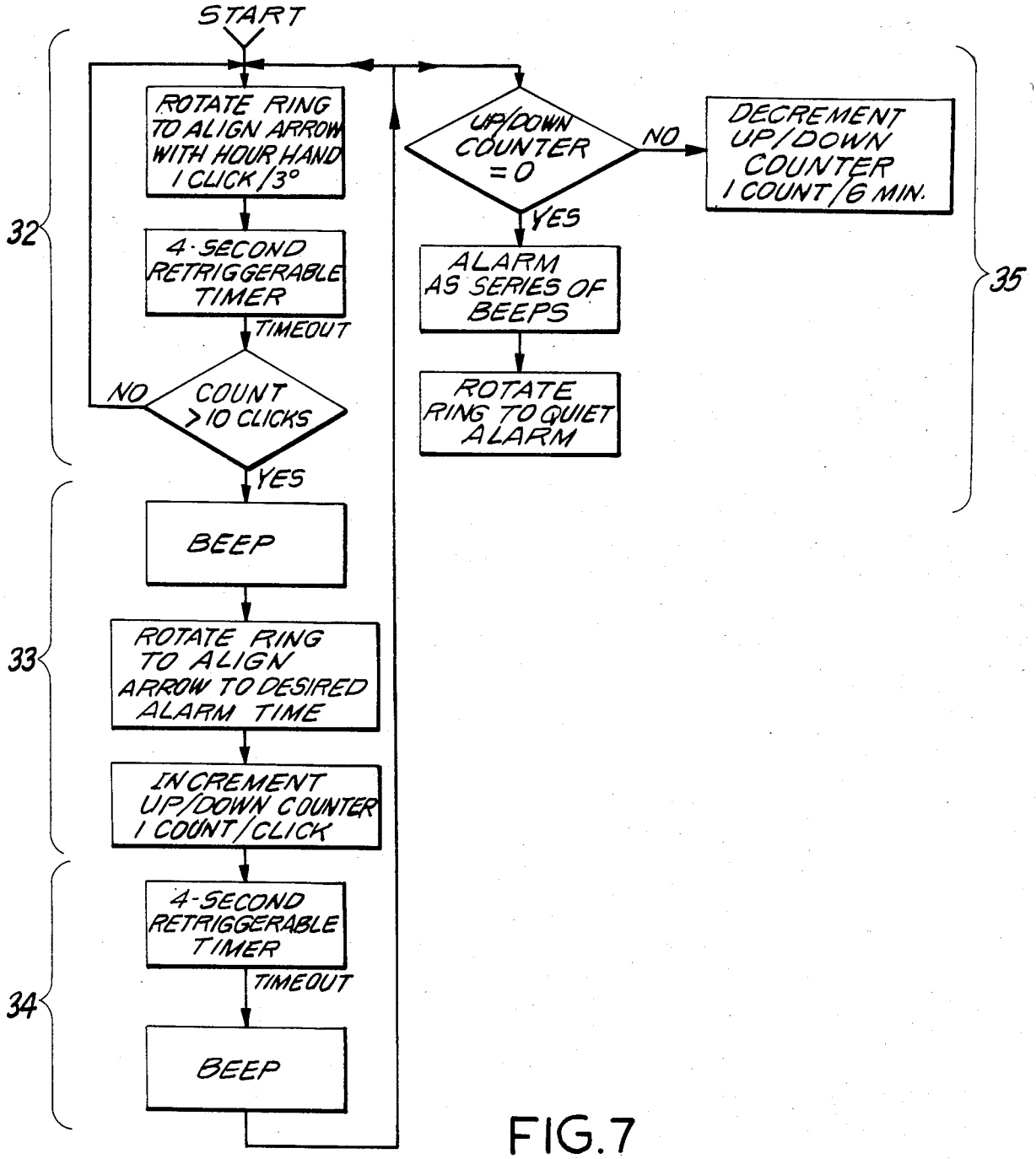

Referring now to FIG. 7 of the drawing, a flow chart is shown of a particular embodiment of the invention. The flow chart is illustrative only of a preferred embodiment of the invention, and is not to be considered as limiting the invention to the particular parameters shown. The resolution of the rotatable ring is 120 clicks per revolution or one click per three degrees of rotation. In order to prevent inadvertent setting of the alarm, a minimum of 30 degrees of rotation, or 10 clicks is required to arm the alarm setting device. This portion of the flow chart is indicated by reference numeral 32. Provided that the ring has been rotated more than 10 clicks, as determined by a second counting means in the logic, and within four seconds as determined by a first retriggerable timer, the control logic circuit 14 sends a signal to alarm driver 15 causing the alarm to beep, indicating that the user may proceed to rotate the ring clockwise to the desired alarm time. With each click the pulse conditioning circuit 17 provides a single pulse from the monostable multivibrator. Each pulse corresponding to a click is supplied to the "up" input of counter 18. This portion of the flow chart is indicated by the reference numeral 33. After the alarm has been set by rotating the ring to the position indicating the desired alarm time hour (see position 8*a* in FIG. 1), a pause for more than four seconds causes a second retriggerable timer to provide a signal indicating that the alarm has been set. This causes the logic circuit to provide an output to the alarm driver and to cause the alarm to beep as indicated by flow chart section 34.

After the alarm has been set, the countdown clock 19 and divider 20 provide accurate timing pulses to the "down" input of counter 18, causing it to decrement at the rate of one count for every six minutes. Six minutes correspond to three degrees of rotation of the rotatable ring and also to three degrees of rotation of the hour hand. When the count of the up/down counter equals zero, the control logic 14 causes the alarm driver 15 to sound a series of beeps lasting approximately 20 seconds or until quieted by rotating the set ring. Rotation produces clicks which, if sensed between beeps quiets the alarm. This portion of operation is indicated on the flow chart at 35.

Figure 8:
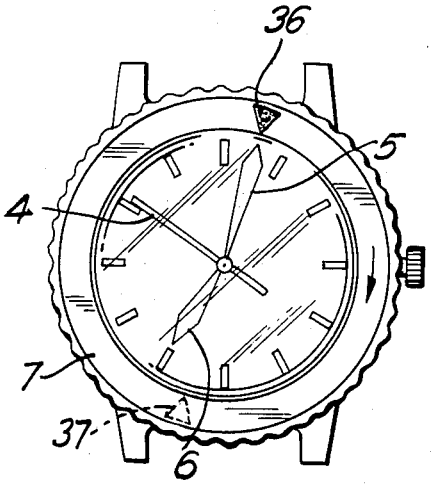

Although the invention is primarily illustrated with respect to setting of an alarm time by rotatably positioning the ring 7 wih respect to the hour hand, the invention can also be implemented to cause the timepiece to act as a "minutes" interval timer. This is done by setting the selector switch 21 to minutes and arming the timer in the usual manner. The ring is armed by rotating at least 30 degrees to stop at the present position of the minutes hand, as shown at 36 on FIG. 8, and then rotated to a desired elapsed time position 37. In this case, the only change in the logic is that the countdown proceeds twelve times as fast as before, or one count per thirty seconds. This corresponds to three degrees of rotation of the minute hand and also to three degrees of rotation of the rotatable ring.

While the electronic timepiece has been described in the form of a quartz analog timepiece with a stepping motor driving mechanical hands, the invention is applicable to any type of timpiece with a hand and piezoelectric transducer. For example, a liquid crystal analog alarm watch with electronically displayed "hands", or a "combo" digital/analog watch, or any type of electronic alarm device with a hand indicating passage of time may utilize the present invention.

The functions of the retriggerable timers, the up/-down counter, an the countdown clock may be implemented either as hardwired logic in flip flops, gates and other conventional elements on the integrated circuit, or may be performed by programming to carry out the various logic steps and to provide timing functions using a series of instructions contained in a read-only memory or ROM associated with the timekeeping circuit.

While there has been described what is considered to be the preferred embodiment of the invention, other modifications will occur to those skilled in the art, and it is desired to cover in the appended claims all such modifications as fall within the true spirit and scope of the invention. For example, while the preferred embodiment uses the same transducer to "hear" the clicks and to produce the alarm sound, it is within the scope of the insertion to use two transduers, one to hear the clicks and the other to produce the sound.

We claim:

1. In an electronic timepiece having a timekeeping ciruit providing timing pulses and display-actuating means moving at least one hand indicating passage of time, and having an alarm including a piezoelectric transducer and an alarm for producing an alarm sound, an improved alarm setting device comprising:

a rotatable ring mounted on said timepiece having an indicia for aligning with said hand in a first rotated position, acoustic means associated with said ring producing a plurality of clicks of preselected acoustic level to said transducer when said ring is rotated to a second rotated position, a pulse conditioning circuit connected to said transducer and providing a pulse for each click, first counting means counting the number of pulses corresponding to the number of clicks between said first and second rotated positions, and logic means connected to said timekeeping circuit and arranged to actuate said alarm after passage of an elapsed time which is proportional to the number of counted pulses.

2. The improvement according to claim 1, wherein said first counting means is an up/down counter having an "up" input responsive to the number of counted pulses and a "down" input responsive to timing pulses indicating passage of time, said up/down counter having an output connected to actuate said alarm when the count reaches zero.

3. The improvement according to claim 1, wherein said ring includes a plurality of circumferentially spaced teeth, and wherein said acoustic means comprises at least one spring member fixedly mounted on the timepiece and biased against said teeth.

4. The improvement according to claim 3, wherein there are a pair of said spring members, and wherein one of the spring members is offset circumferentially by one-half a tooth pitch, whereby the number of clicks per revolution is twice the number of teeth.

5. The improvement according to claim 1, wherein said ring includes "t" circumferentially spaced teeth, and wherein there is at least one spring member biased against said teeth to produce at least "t" clicks per revolution of said ring.

6. The improvement according to claim 5, wherein there are "n" spring members, whereby there are "nt" clicks per revolution of said ring.

7. The combination according to claim 1, wherein said display actuating means is a stepping motor driving at least one mechanical analog hand.

8. The combination according to claim 1, wherein said display actuating means is a liquid crystal display having at least one electronically displayed analog "hand".

9. The improvement according to claim 1, wherein said alarm comprises an alarm driving circuit connected to actuate said transducer.

10. The improvement according to claim 9, wherein said logic means includes first retriggerable timer means and second counting means together arranged to require a given member of counted pulses within a given time and to generate a sound by the transducer, whereby a predetermined ring rotation is required to signal arming of said alarm setting device.

11. The improvement according to claim 9, wherein said logic means includes second retriggerable timer means arranged to generate a sound by the transducer when preselected time has elapsed after arming said alarm setting device, thereby indicating that the alarm has been set.

12. The improvement according to claim 9, wherein said transducer is adapted to produce an alarm sound comprising a series of beeps and wherein said logic means includes means disabling the alarm if the ring is rotated to produce a click between beeps while the transducer is producing an alarm sound.

13. The improvement according to claim 1, wherein said timepiece has an hour hand and a minute hand, and wherein the logic means provides for decrementing the first counting means at two different rates, together with switching means for selecting the rate, whereby the alarm setting device can be used as an "hours" timer or as a "minutes" timer.

* * * * *